US012577010B2

(12) United States Patent
Thingelstad

(10) Patent No.: US 12,577,010 B2
(45) Date of Patent: Mar. 17, 2026

(54) FILLING MACHINE

(71) Applicants: Elopak ASA, Spikkestad (NO); Shikoku Kakoki Co., Ltd., Tokushima (JP)

(72) Inventor: Lars Aksel Thingelstad, Drammen (NO)

(73) Assignees: Elopak ASA, Spikkestad (NO); Shikoku Kakoki Co., Ltd, Tokushima (JP)

( * ) Notice: Subject to any disclaimer, the term of this patent is extended or adjusted under 35 U.S.C. 154(b) by 9 days.

(21) Appl. No.: 18/565,547

(22) PCT Filed: Jun. 3, 2022

(86) PCT No.: PCT/EP2022/065233
§ 371 (c)(1),
(2) Date: Nov. 30, 2023

(87) PCT Pub. No.: WO2022/254026
PCT Pub. Date: Dec. 8, 2022

(65) Prior Publication Data

US 2024/0239541 A1 Jul. 18, 2024

(30) Foreign Application Priority Data

Jun. 4, 2021 (NO) ..... 20210717

(51) Int. Cl.

| | |
|---|---|
| ***B67C 7/00*** | (2006.01) |
| ***B65B 3/04*** | (2006.01) |
| ***B65B 7/28*** | (2006.01) |
| ***B65B 43/52*** | (2006.01) |
| ***B65B 55/02*** | (2006.01) |

(52) U.S. Cl.
CPC ..... *B65B 55/025* (2013.01); *B65B 3/04* (2013.01); *B65B 7/2878* (2013.01); *B65B 43/52* (2013.01); *B65B 2210/06* (2013.01)

(58) Field of Classification Search
CPC ... B65B 55/025; B67C 3/2642; B67C 7/0073; B67C 2003/228
See application file for complete search history.

(56) References Cited

U.S. PATENT DOCUMENTS

| | | | | |
|---|---|---|---|---|
| 7,854,238 | B2 * | 12/2010 | Zatarain | F25D 21/14 137/247.11 |
| 8,944,079 | B2 | 2/2015 | Auer et al. | |
| 2012/0085370 | A1 | 4/2012 | Auer et al. | |

FOREIGN PATENT DOCUMENTS

| | | |
|---|---|---|
| CN | 208052429 | 6/2018 |
| DE | 102005004658-X | 6/2006 |

(Continued)

OTHER PUBLICATIONS

ISRWO in PCT/EP2022/065233.

(Continued)

*Primary Examiner* — Paul J Gray
(74) *Attorney, Agent, or Firm* — Christian D. Abel

(57) ABSTRACT

The present invention relates to a filling machine and a method for filling product into containers, in particular liquid foodstuff. The filling machine provides a working chamber with a clean zone for filling containers while the containers are conveyed through the working chamber. The clean zone is provided by introducing HEPA-filtered air into the working chamber through fluid inlets.

11 Claims, 8 Drawing Sheets

(56) References Cited

FOREIGN PATENT DOCUMENTS

| | | |
|---|---|---|
| JP | 63-133218 | 10/1988 |
| JP | H08152171 | 6/1996 |
| JP | 2004299723 | 10/2001 |
| WO | WO 2016/091669 | 6/2016 |
| WO | WO 2017/035448 Y | 3/2017 |

OTHER PUBLICATIONS

Norwegian Search Repost in NO20210717.
Office Action of Sep. 18, 2025 from Japanes Patent office in corresponding applciation JP 2023-574155, subitted inter alia as a statement of relevance for any non-English references cited therein.
CN Office Action dated Nov. 1, 2025 in 202280039870.2, submitted inter alia as a Statement of Relevance for any non-English references cited therein.

* cited by examiner

FILLING MACHINE

TECHNICAL FIELD

The present invention relates to a filling machine for filling product into containers, in particular liquid foodstuffs, while the containers are being conveyed through a working chamber in an clean atmosphere where the containers are acted upon by a fluid, in particular HEPA-filtered air, for providing a clean atmosphere, and a method for use thereof.

BACKGROUND AND PRIOR ART

When filling liquid foodstuff into containers it has proven expedient to use a filling machine where containers are conveyed on a conveyor from an inlet side to an outlet side of a working chamber. While the containers are conveyed they are, starting at the inlet side, treated with a cleaning agent or sterilized for example by being acted upon by ultraviolet light. The containers then enter a filling region in the working chamber where the liquid foodstuff is filled into the containers. The containers are then conveyed to a closing region within the working chamber. The filling region and the closing region within the working chamber are typically separated by a wall running transversely to the conveying path. The containers are closed in the closing region which comprises a heater and a sealer. The heater supplies hot air to the top of the container and the sealer folds and presses the open container in order to close and seal the container by forming a gable.

It is necessary to maintain a clean atmosphere in the working chamber above the open containers in order to obtain filled containers without contamination from particles, bacteria or viruses which would severely compromise the quality and the shelf life of the food product in the filled containers. The clean atmosphere is typically obtained by supplying the working chamber with a fluid such as HEPA-filtered air, aimed at the containers from fluid inlet openings above the containers.

The working chamber must be cleaned with regular intervals in order to maintain the clean atmosphere in the working chamber. In particular, water, alkali- or acid-based cleaning products and hydrogen peroxide aerosols are considered as suitable cleaning media for the working chamber.

In one commercially available filling machine HEPA-air is provided to the working chamber via a plenum with a plurality of through holes located in the ceiling of the working chamber. This arrangement may cause challenges with turbulence and backflow causing the flow of HEPA-air to be inconsistent around the conveyor and the top of the containers. The plenum needs to be quite large to equalize the HEPA-air pressure over the plurality of through-openings in order to facilitate a uniform flow. The large plenum makes for a voluminous filling machine and it can be challenging to clean the inside of the plenum.

A filling machine known from U.S. Pat. No. 8,944,079 B2 comprises a working chamber for filling product into containers having an external line for introducing sterile fluid into the working chamber. The external line extends through the working chamber and has openings disposed over the containers for uniformly spreading sterile fluid over the containers which are disposed underneath the external line. This external line surrounds an internal line which is configured to dispense a cleaning medium from nozzles. The internal line rotates within the external line to properly clean the inside of the external line. This configuration has challenges with backflow of un-sterile hot air from the heater and the mass flow of sterile air in the working chamber was not suitable in all operating conditions to maintain a clean atmosphere.

EP3230169 B1 provides a filling machine much like the one described in U.S. Pat. No. 8,944,079 B2, but wherein the sterile atmosphere in the working chamber is improved. The annular chamber between the internal line and the external line is configured such that the cross-sectional area is gradually reduced down to virtually zero. This provides a constant static pressure over the length of the annular chamber which results in a uniform flow of clean fluid over the length of the filling region. This configuration still has problematic regions with back-flows and turbulence. This is solved by adding flow bodies for managing the flow resistance in the working chamber. The cleaning procedure requires the internal line to rotate within the external line while dispensing a cleaning medium.

It is thus an object of the present invention to provide a filling machine for filling product into containers in a clean zone which at least mitigate the above-mentioned disadvantages of the prior art.

More particular, it is an object of the present invention to provide a filling machine with a compact supply for HEPA-air wherein the working chamber and the supply for HEPA-air is easy to clean.

Also, it is an object of the present invention to provide a method for filling containers by use of said filling machine.

SUMMARY OF THE INVENTION

The present invention is set forth and characterized in the main claims, while the dependent claims describe other characteristics of the invention.

In one aspect the present invention concerns a filling machine comprising a working chamber which comprises side walls, a ceiling and a floor, wherein containers are conveyed through the working chamber by a conveyer, from an inlet side to an outlet side, wherein the working chamber comprises at least one station within the working chamber configured to execute a working step on the containers, where the filling machine comprises a plurality of fluid inlets, wherein each fluid inlet comprises a convex fluid inlet surface facing the working chamber and displaying a plurality of through openings configured to supply the working chamber with a fluid for creating a clean zone around the at least one station, and wherein each fluid inlet is fluidly connected to a supply conduit for supplying the fluid to the working chamber.

In one configuration of the filling machine the fluid inlet surface is located at the ceiling.

In one configuration of the filling machine the cross section of the supply conduit increases towards the end proximal to the fluid inlet.

In one configuration of the filling machine the supply conduit comprises a cleaning nozzle disposed within the supply conduit for spraying a cleaning medium onto the inner surface of the supply conduit and the fluid inlet.

In another exemplary configuration of the filling machine the supply conduit has a circular cross section. Square, rectangular, triangular and other cross-sectional shapes may also be used.

In one configuration of the filling machine the fluid inlet surface has the shape of a spherical or an ellipsoidal cap.

In one configuration of the filling machine the radius of curvature of the fluid inlet surface is greater distal from the ceiling than the radius of the curvature of the fluid inlet surface proximal to the ceiling.

In one configuration of the filling machine the fluid inlet comprises a first surface area with a surface curvature having a first radius r1 and a second surface area with a surface curvature having a second radius r2, wherein the first radius r1 is greater than the second radius r2.

In one configuration of the filling machine the fluid inlet surface has the shape of a torispherical surface comprising a first surface area with a surface curvature having a first radius r1 and a second surface area with a surface curvature having a second radius r2.

In one configuration of the filling machine the fluid inlet surface has the shape of a semi ellipsoidal surface comprising a first surface area with a surface curvature having a first radius r1 and a second surface area with a surface curvature having a second radius r2.

In one configuration of the filling machine the fluid inlet surface displays the through openings at least in both the first surface area with a surface curvature having a first radius r1 and the second surface area with a surface curvature having a second radius r2.

In one configuration of the filling machine the fluid inlet surface comprises a first surface area with a surface curvature having a first radius r1 and a second surface area with a surface curvature having a second radius r2, wherein the first radius r1 is greater than the second radius r2, wherein the fluid inlet surface is configured to supply the working chamber with the fluid for creating a clean zone around the at least one station at a ratio for providing a larger portion of the fluid for creating a clean zone around the at least one station through the through openings displayed in the first surface area with a surface curvature having a first radius r1 than through the second surface area with a surface curvature having a second radius r2, said ratio of fluid for creating a clean zone around the at least one station between the supply from the first surface area with a surface curvature having a first radius r1 and second surface area with a surface curvature having a second radius r2 is between 10:9-10:1, 5:4-5:1, 10:7-4:1, 3:2-3:1, 5:3-3:1, 5:3-2:1.

In one configuration of the filling machine the supply conduit and the fluid inlet surface comprises a longitudinal axis A wherein the through openings comprised in the first surface area with a surface curvature having a first radius r1 may be configured to distribute the fluid for creating a clean zone around the at least one station at a distribution angle of max Y° from the axis A, covering a larger area distal from the fluid inlet surface than proximal to the fluid inlet surface.

In one configuration the distribution angle Y° is between 10°-40°, 15°-35°. 17°-32°, 20°-30°. 23°-28° or 26.5°.

In one configuration of the filling machine the through openings comprised in the second surface area with a surface curvature having a second radius r2 may be configured to distribute the fluid for creating a clean zone around the at least one station at a distribution angle of max X° from the axis A, covering a larger area distal from the fluid inlet surface than proximal to the fluid inlet surface.

In one configuration the distribution angle X° is between 40°-89°, 55°-85°. 60°-80°, 65°-78°. 70°-77° or 75°.

In another configuration of the filling machine each fluid inlet is fluidly connected to a respective supply conduit.

In one configuration of the filling machine the working chamber is divided into a filling region and a closing region by a wall extending transversely within the working chamber, wherein the filling region is proximal to the inlet side and the closing region is proximal to the outlet side.

In one exemplary configuration of the filling machine the filling region comprises at least one of said plurality of fluid inlets, and the closing region comprises at least one of said plurality of fluid inlets.

In another configuration of the filling machine the filling region comprises at least two of said plurality of fluid inlets, and the closing region comprises at least two of said plurality of fluid inlets.

In one configuration of the filling machine, the filling region comprises a filling station for filling containers and the closing region comprises a heating station for heating the containers and a sealing station for sealing the containers.

In a second aspect the present invention concerns a method for filling containers using a filling machine comprising the steps:

A. providing a filling machine comprising:
  a working chamber comprising side walls, a ceiling and a floor,
  wherein containers are conveyed through the working chamber by a conveyer, from an inlet side to an outlet side, wherein the working chamber comprises
    at least one station within the working chamber configured to execute a working step on the containers, and
    a fluid inlet with a fluid inlet surface, the fluid inlet surface comprising a plurality of through openings configured to supply the working chamber with fluid for creating a clean zone in the working chamber, and wherein
    the fluid inlet is fluidly connected to a supply conduit for supplying fluid to the working chamber, wherein
  the fluid inlet surface comprises a convex surface facing the working chamber, and
B. creating a clean zone in the working chamber around the at least one station by supplying a fluid to the at least one station from a plurality of fluid inlets,
  wherein each fluid inlet comprises a convex fluid inlet surface facing the working chamber and displaying a plurality of through openings configured to supply the working chamber with a fluid for creating a clean zone around the at least one station, and
  wherein each fluid inlet is fluidly connected to a supply conduit for supplying the fluid to the working chamber.

The filling machine may be in accordance with any of the characteristics described above under the first aspect of the invention.

In order to fill the containers with product, the following steps may be performed:

C. providing the filling machine according to the characteristics described above, the filling machine further comprising:
  a filling station for filling containers, and
  a heating station for heating the containers and
  a sealing station for sealing the containers, and
  while conveying the containers from the inlet side towards the outlet side,
D. filling the containers with foodstuff at the filling station,
E. heating the containers at the heating station, and sealing the containers at the sealing station.

In order to clean the filling machine, the surfaces within the working chamber, the supply conduit, the fluid inlet, the fluid inlet surface and the fluid inlet through openings the following steps may be performed:

F. providing the filling machine according to characteristics described above, the filling machine further comprising:
   a cleaning nozzle disposed within the supply conduit for spraying a cleaning medium onto the inner surface of the supply conduit and the fluid inlet, and
   a plurality of cleaning nozzles disposed within the working chamber for spraying a cleaning medium onto the surfaces within the working chamber,
G. operating the cleaning nozzles for cleaning the inner surface of the supply conduit and the fluid inlet, and
H. operating the cleaning nozzles disposed within the working chamber for cleaning the surfaces within the working chamber, and
I. optionally repeating steps A-I.

DETAILED DESCRIPTION OF THE INVENTION

In the following, specific embodiments of the invention will be described in more detail with reference to the drawings. However, the invention is not limited to the embodiments and illustrations contained herein. It is specifically intended that the invention includes modified forms of the embodiments, including portions of the embodiments and combinations of elements of different embodiments. It should be appreciated that in the development of any actual implementation, as in any engineering or design project, specific decisions must be made to achieve the developer's specific goals, such as compliance with system and/or business-related constraints. Moreover, it should be appreciated that such a development effort might be complex and time consuming, but would nevertheless be a routine undertaking of design, fabrication and manufacture for the skilled person having the benefit of this disclosure.

Figure 1:
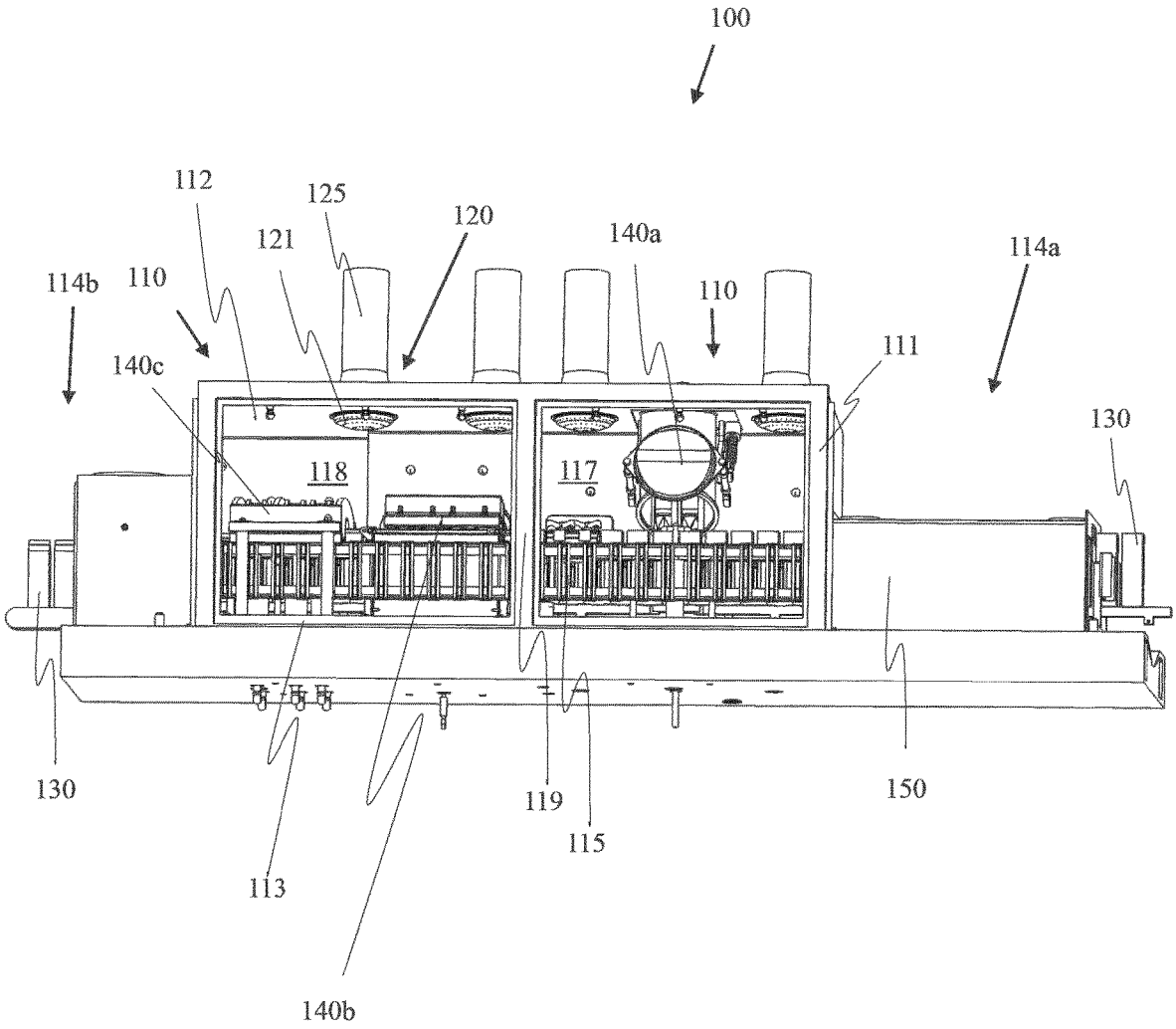
FIG. 1 illustrates a side view of the filling machine having a working chamber with containers on a conveyor, a filing region, closing region and a plurality of fluid inlets through the ceiling of the working chamber.
Figure 2:
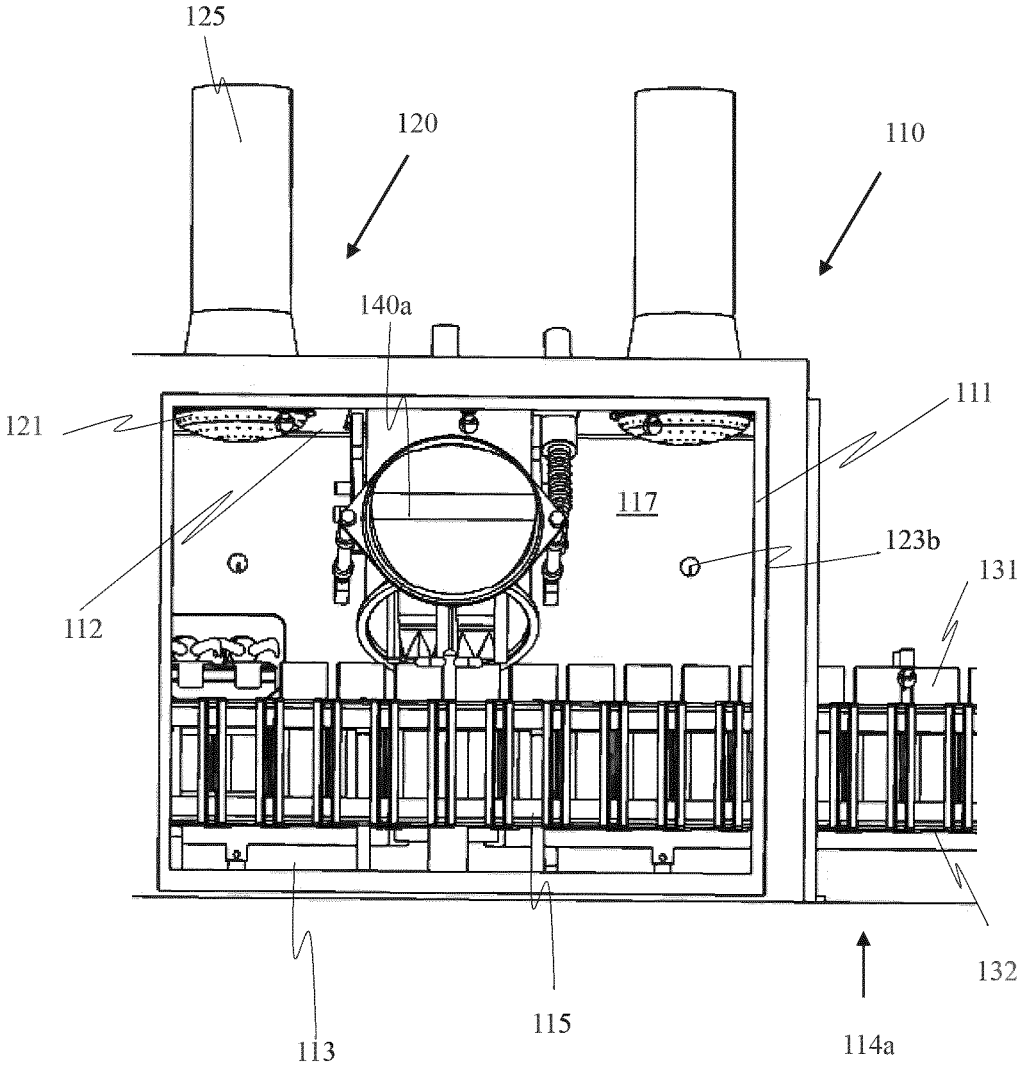
FIG. 2 shows details of the filling region with a filling station and cleaning nozzles.
Figure 3:
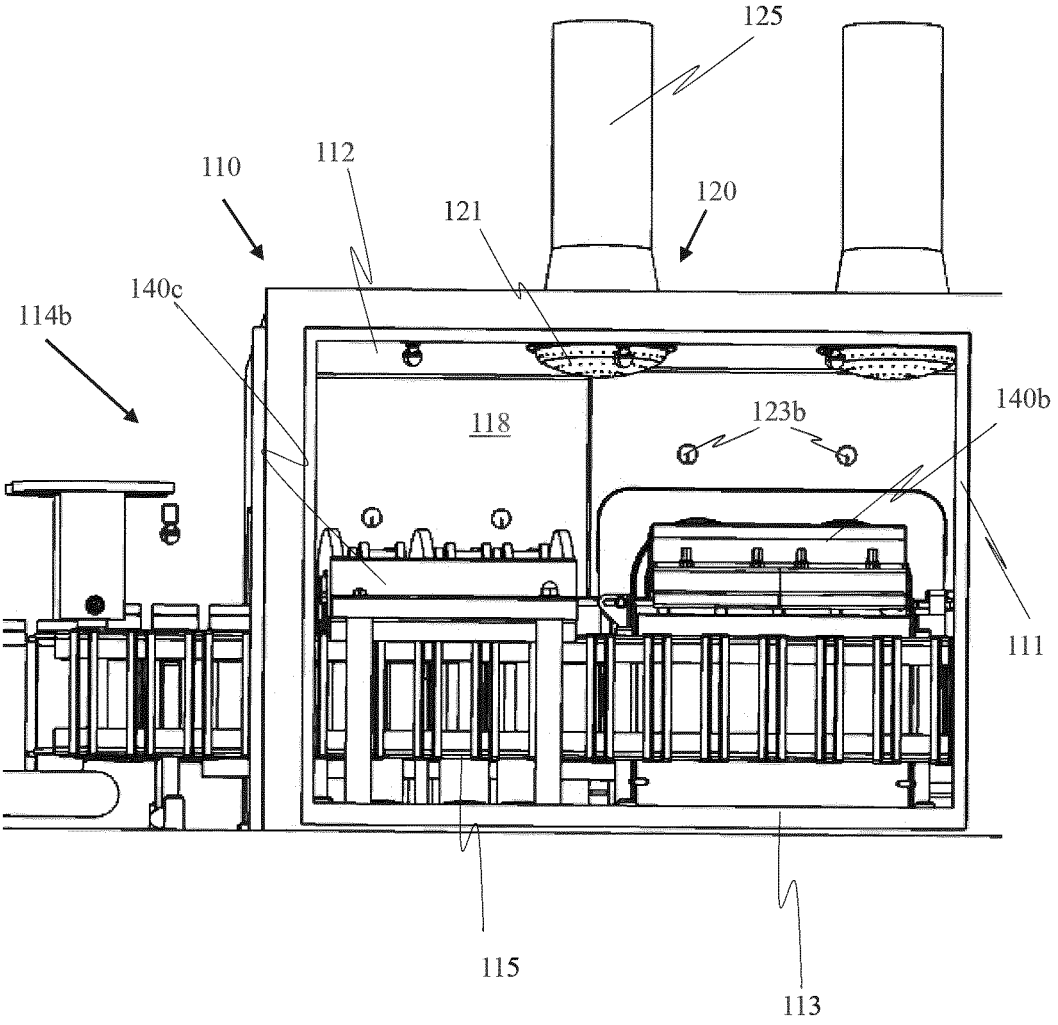
FIG. 3 shows a side view of the closing region with a heating station and a closing station.

With reference to FIGS. 1-3, the filling machine 100 as shown, includes a working chamber 110 suitable for providing a clean atmosphere. The working chamber 110 is defined by side walls 111, a ceiling 112 and a floor 113. The working chamber 110 has a hollow cuboid shape. The working chamber 110 comprises a conveyer 115 which is configured to convey containers 130 from an inlet side 114*a* to an outlet side 114*b* of the working chamber 110. The working chamber 110 has a longitudinal direction from the inlet side 114*a* to the outlet side 114*b*. The containers 130 are designed to hold liquid foodstuff such as a beverage.

Proceeding from the inlet side 114*a* to the outlet side 114*b*, the working chamber 110 is divided into a filling region 117 and a closing region 118 by a wall 119. The wall 119 extends transversely to the longitudinal direction of the working chamber 110.

The filling region 117 is located proximal to the inlet side 114*a* and the closing region 118 is located proximal to the outlet side 114*b*.

The filling machine 100 comprises a decontamination tunnel 150 located outside the working chamber 110 in connection with the inlet side 114*a*. Prior to entering the filling region 117 the containers 130 is conveyed by the conveyor 115 through the decontamination tunnel 150 and subjected to decontamination therein. The decontamination includes exposure of the containers 130 to UV-light.

The containers 130 enters the working chamber 110 by means of the conveyor 115 in an open state. The filling of liquid foodstuff into the containers 130 takes place in the filling region 117 by means of a filling station 140*a* located in the filing region.

Still in an open state, the filled containers 130 are conveyed into the closing region 118 where the container top ends 131 are heated by means of a heating station 140*b*.

The containers 130 are then conveyed to a sealing station 140*c* located in the closing region 118. The containers 130 are closed and sealed by the sealing station 140*c* which forms a gable by folding of the container top ends 131. Finally, the containers 130 exit the working chamber 110 through the side wall 111 at the outlet side 114*b* by means of the conveyer 115.

It is necessary to maintain a clean atmosphere in the working chamber 110, in particular above the open containers 130 in order to obtain filled containers 130 without contamination from particles, bacteria or viruses which would severely compromise the quality and the shelf life of the liquid food product in the filled containers 130. The clean atmosphere is obtained by supplying the working chamber 110 with HEPA-air.

As used herein the term HEPA-air relates to air that is filtered through a HEPA filter. A HEPA-filter is a high efficiency particulate air filter. HEPA filters, as defined by the United States Department of Energy (DOE) standard adopted by most American industries, remove at least 99.97% of aerosols 0.3 micrometers (μm) in diameter. HEPA filters capture pollen, dirt, dust, moisture, bacteria (0.2-2.0 μm), virus (0.02-0.3 μm). Per definition HEPA-air is suitable for creating a clean zone when introduced into a working chamber.

The working chamber 110 comprises a plurality of fluid inlets 120. Each of the said fluid inlets 120 comprises a convex fluid inlet surface 121 that faces the working chamber 110. Each of the fluid inlet surface 121 is located at the ceiling 112 and displays a plurality of through openings 122. Each of the fluid inlets 120 is fluidly connected to a supply conduit 125 which supplies HEPA-air to each respective fluid inlet 120. The HEPA-air is introduced to the working chamber through the through openings 122.

The through openings 122 are configured to aim a continuous laminar and uniform flow of HEPA-air from the fluid inlet surface 121 at least down to below the vertical level of the container top ends 131 when the containers 130 are being conveyed. The laminar and uniform HEPA-air flow provides a clean zone that extends from the fluid inlet surfaces 121 to below the vertical level of the container top ends 131 when the containers 130 are being conveyed, throughout the working chamber 110, and thereby prevents any contaminants from entering into the containers 130 while being conveyed through the working chamber 110.

Figure 4:
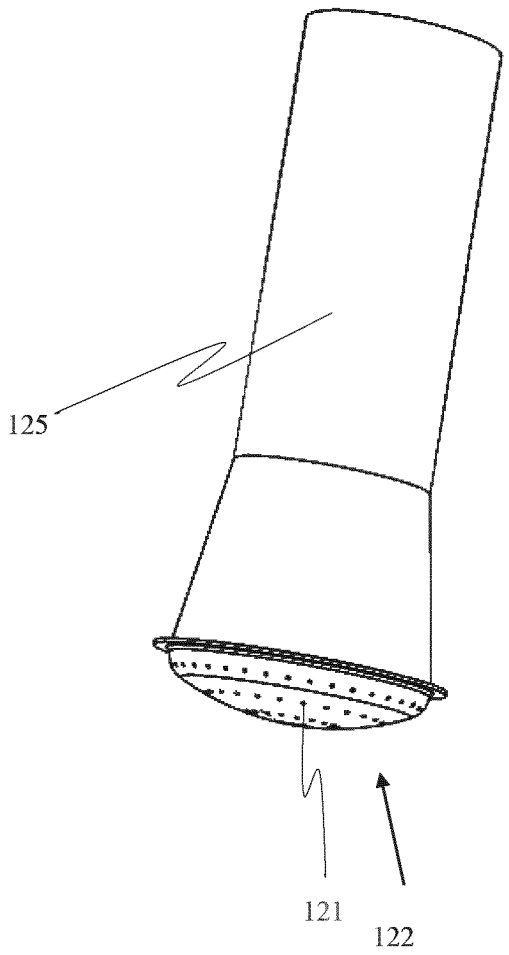
FIG. 4 shows an isolated supply conduit with a convex fluid inlet surface and a plurality of openings.

As shown in FIG. 4 the fluid inlet surface 121 has a convex ellipsoidal shape facing the working chamber 110, where the radius of the curvature of the fluid inlet surface 121 is greater distal from the ceiling 112 than the radius of the curvature of the fluid inlet surface 121 proximal to the ceiling 112. Said ellipsoidal shape of the fluid inlet aids in equalizing the pressure of the HEPA-air over the through openings 122. Said ellipsoidal shape also provides a surface suitable for the through openings 122 to produce a laminar and uniform HEPA-air flow to be aimed directly at the container top ends 131 while they are conveyed in the working chamber.

To further aid the provision of a uniform and laminar HEPA-air flow in the working chamber 110 the pressure of the HEPA-air is equalized over the through openings 122. The supply conduit 125 has the shape of a circular pipe with a cross section that is suitable for providing a slow HEPA-air flow velocity. The cross section of the supply conduit 125 increases towards the end proximal to the fluid inlet surface 121. This further slows the HEPA-air flow velocity and aids in equalizing the pressure of the HEPA-air over the through openings 122, which in turn provides a uniform and laminar HEPA-air flow. When the pressure of the HEPA-air is equalized over the plurality of through openings 122 the risk of undesired backflow of air from the working chamber 110, which may lead to contamination is reduced.

The configuration of the filling machine 100 with the supply conduits 125 allows for a more compact design than when using one plenum for equalizing pressure over the through openings 122. This is due to that a plenum needs to have a much larger volume for slowing the HEPA-air flow velocity than what is needed when using the supply conduits 125 as describe herein.

Figure 5:
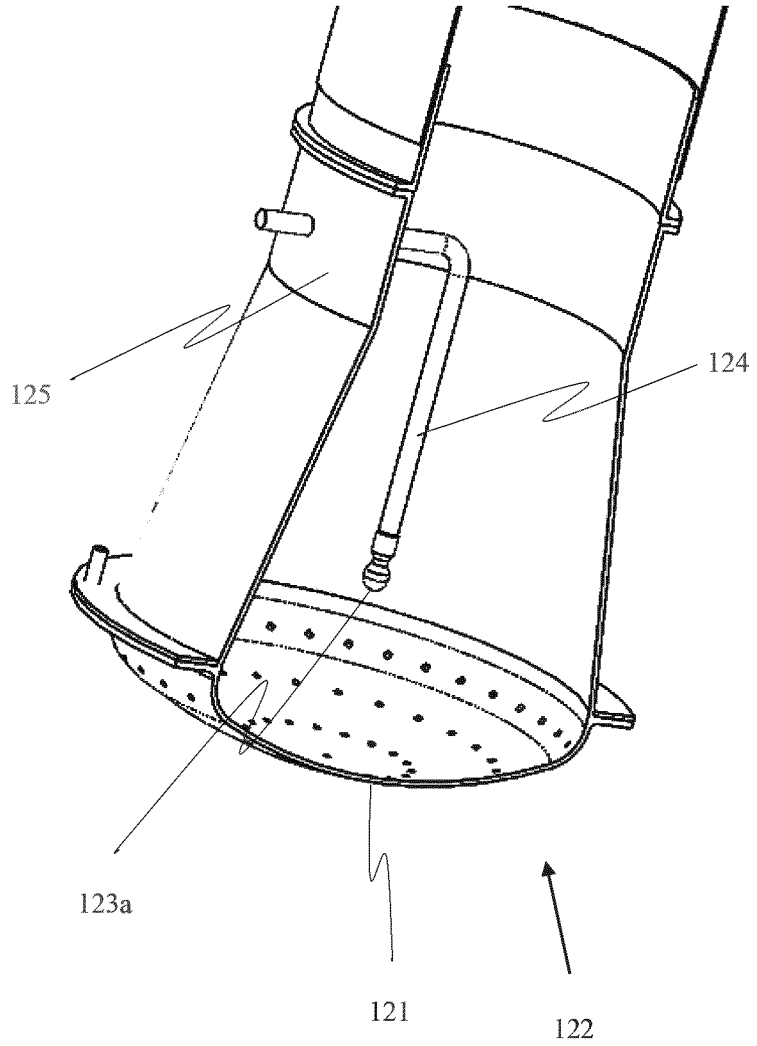
FIG. 5 shows a cross sectional view of an isolated supply conduit with a convex inlet surface, a plurality of openings and a cleaning nozzle disposed within the supply conduit.

After the completion of filling and conveying a number of containers 130 the working chamber 110 and the supply conduits 125 must be cleaned. As shown in FIG. 5 the supply conduits 125 comprises a supply conduit cleaning nozzle 123*a* disposed within the supply conduits 125 configured for spraying a cleaning medium onto the inner surface of the supply conduit 125 and the fluid inlet 120. The cleaning medium sprayed form the supply conduit cleaning nozzle 123*a* also reaches the through openings 122. The supply conduit cleaning nozzle 123*a* is fluidly connected to a pipe 124 for supplying cleaning medium to the supply conduit cleaning nozzle 123*a*.

With reference to FIGS. 1-3 the working chamber 110 comprises at least one working chamber cleaning nozzle 123*b* for cleaning the surfaces within the working chamber 110.

Figure 6:
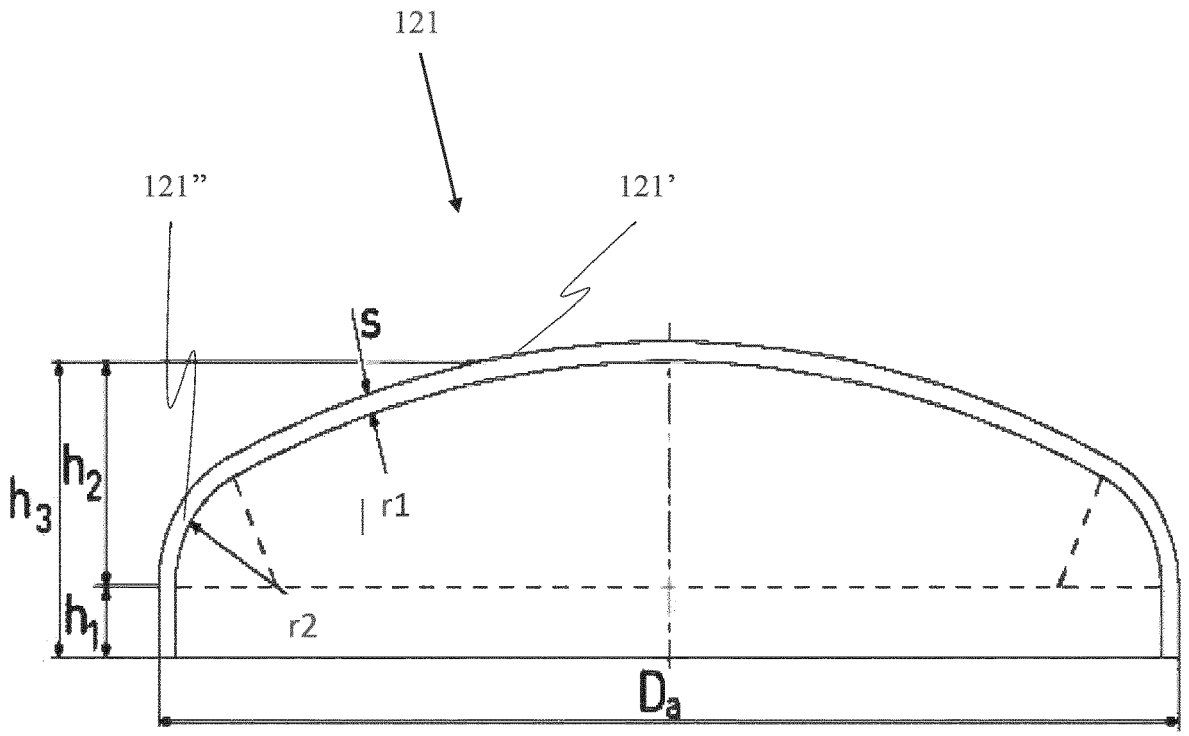
FIG. 6 shows a cross sectional view of an isolated supply conduit where the convex inlet surface displays a torispherical shape.

Now turning to FIG. 6 which shows one embodiment where the convex fluid inlet surface 121 is in the shape of a torispherical surface. As used herein a torispherical surface is the surface obtained from the intersection of a spherical cap with a tangent torus. The torispherical fluid inlet surface 121 comprises a first surface area 121' with a surface curvature having a first radius r1 and a second surface area 121" having a curvature with a second radius r2. The radius r1 is greater than the radius r2.

With reference to FIGS. 1-4, it is shown that when installed in the filling machine 100 the torispherical surface area with a curvature of radius denoted r1 is distal from the ceiling 112 and the torispherical surface area with a curvature radius denoted r2 is proximal to the ceiling.

The measurements of the torispherical surface is defined by:

$r_1$=Radius of the sphere.

$r_2$=Radius of the torus.

$h_1$=Height from the base of the fluid inlet surface to the base of the torus.

$h_2$=Height from the base of the torus to the peak of the fluid inlet surface.

$h_3=h_1+h_2$=Height from the base of the fluid inlet surface to the peak of the fluid inlet surface.

$D_a$=Diameter.

s=normal thickness of the material comprising the fluid inlet surface.

One preferred example of the embodiment shown in FIG. 6 is defined by the measurements according to DIN 28011 standards.

Figure 7:
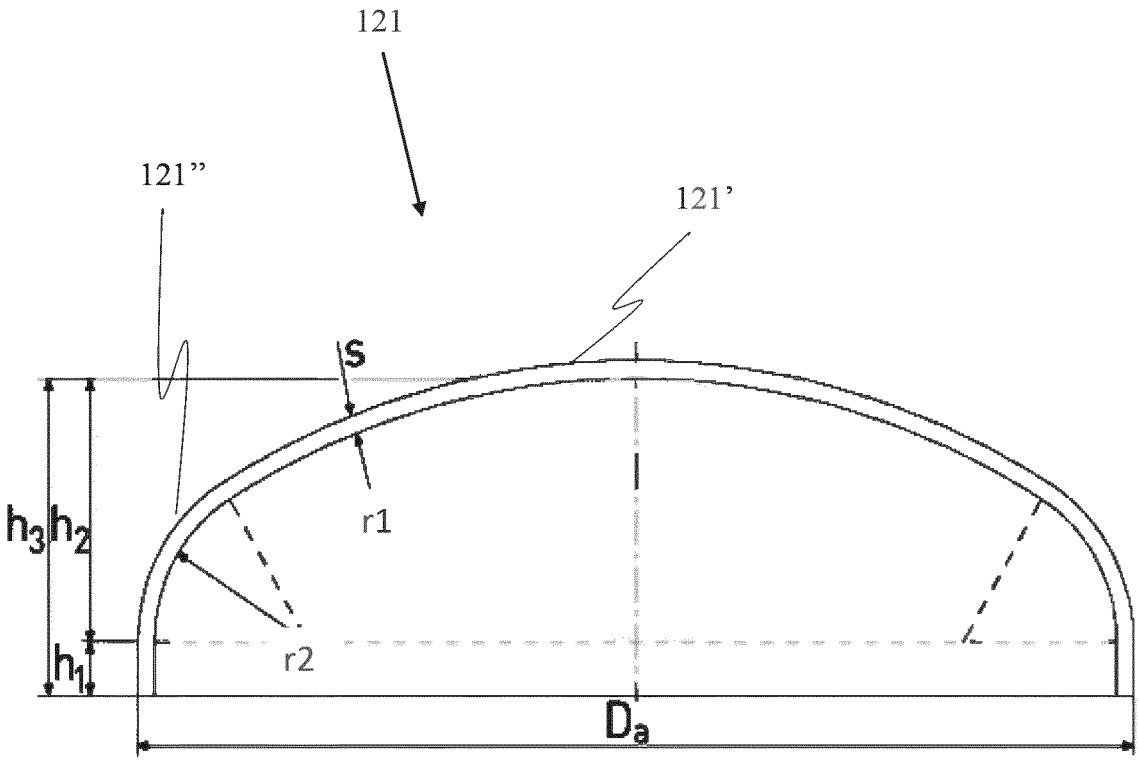
FIG. 7 shows a cross sectional view of an isolated supply conduit where the convex inlet surface displays a semi-ellipsoidal shape.

Now turning to FIG. 7 which shows one embodiment where the convex fluid inlet surface 121 is in the shape of a semi ellipsoidal surface. The semi ellipsoidal fluid inlet surface 121 comprises a first area with a surface curvature having a radius denoted r1 and a second surface area 121" with a surface curvature having a radius denoted r2. The radius r1 is greater than the radius r2.

With reference to FIGS. 1-4, it is shown that when installed in the filling machine 100 the semi ellipsoidal surface area with a curvature of radius denoted r1 is distal from the ceiling 112 and the semi ellipsoidal surface area with a curvature radius denoted r2 is proximal to the ceiling.

The measurements of the semi ellipsoidal fluid inlet surface 121 are defined by:

$r_1$=Radius of the curvature of the first area.

$r_2$=Radius of the curvature of the second area.

$h_1$=Height from the base of the fluid inlet surface to the base of the torus.

$h_2$=Height from the base of the torus to the peak of the fluid inlet surface.

$h_3=h_1+h_2$=Height from the base of the fluid inlet surface to the peak of the fluid inlet surface.

$D_a$=Diameter.

s=normal thickness of the material comprising the fluid inlet surface

One preferred example of the embodiment shown in FIG. 7 is defined by the measurements according to DIN 28013 standards.

For all embodiments the through openings 122 may be configured such that the through openings 122 displayed in the area of the radius r1 combined supplies the working chamber 110 with a larger portion of the fluid for creating a clean zone around the at least one working station 140*a*, 140*b* 140*c* compared to the through openings 122 displayed in the area of the radius r2 combined. The skilled person would acknowledge that this difference in the supplied portion of the fluid for creating a clean zone around the at least one working station 140*a*, 140*b* 140*c* can be achieved by distributing the through openings 122 over the fluid inlet surface 121 such that there are a higher number of through openings 122 displayed in the area of the radius r1 than in the area of the radius r2 and/or by varying the size of the though openings 122 in the in the area of the radius r1 and in the area of the radius r2.

Figure 8:
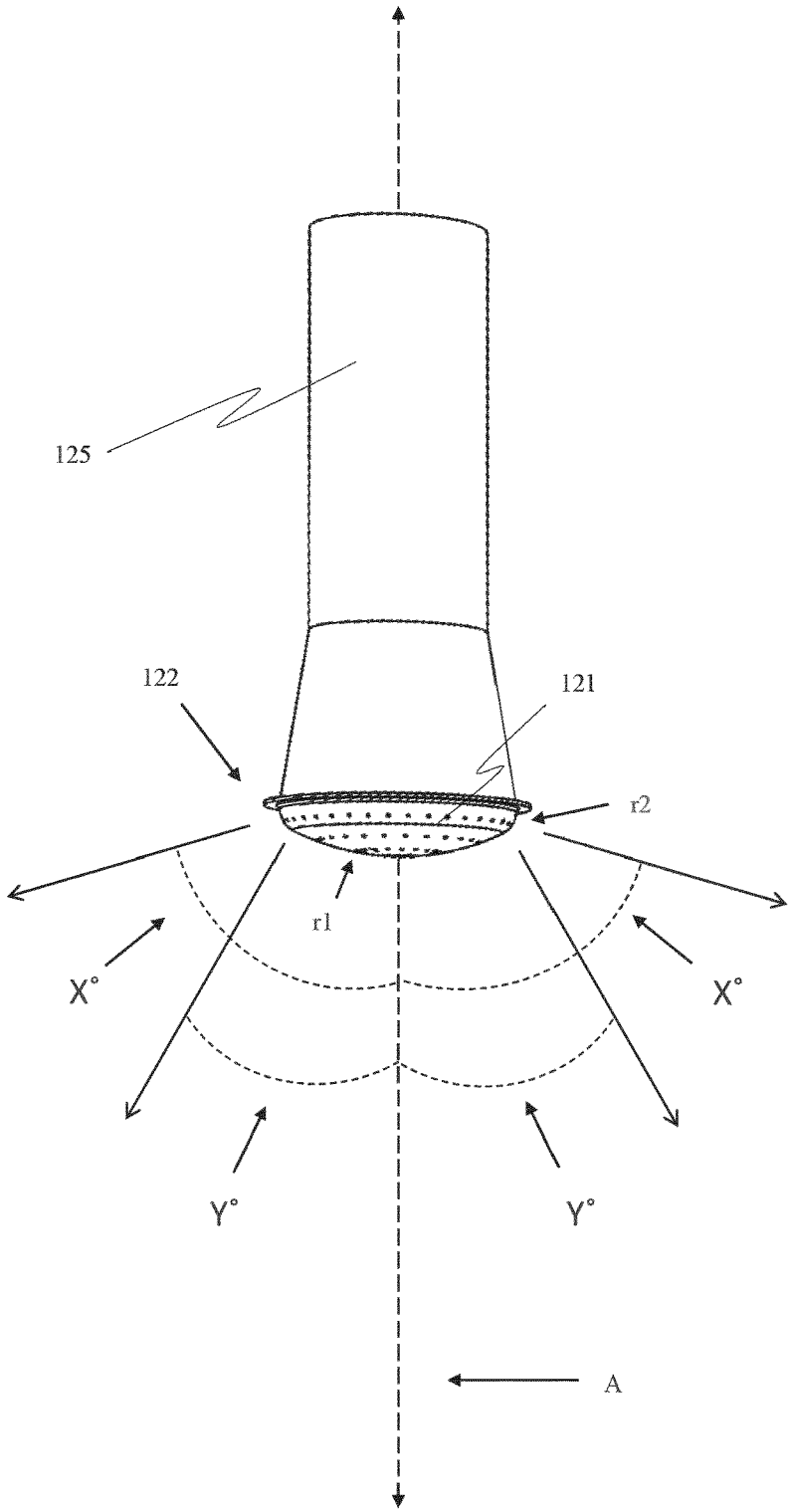
FIG. 8 shows the longitudinal axis of the fluid inlet and the fluid inlet surface.

Now turning to FIG. 8 which shows that the supply conduit 125 and the fluid inlet surface 121 comprises a longitudinal axis A. The through openings 122 comprised in the first surface area 121' having the first radius r1 may be configured to distribute the fluid for creating a clean zone around the at least one working station at a distribution angle of max Y° from the axis A, covering a larger area distal from the fluid inlet surface 121 than proximal to the fluid inlet surface 121.

The distribution angle Y° may be from 10°-40°. 15°-35°, 17°-32°, 20°-30°, 23°-28° or 26.5°.

The through openings 122 comprised in the second surface area 121" having the second radius r2 may be configured to distribute the fluid for creating a clean zone around the at least one working station at a distribution angle of max X° from the axis A, covering a larger area distal from the fluid inlet surface 121 than proximal to the fluid inlet surface 121.

The distribution angle X° may be between 40°-89°, 55°-85°, 60°-80°, 65°-78°, 70°-77° or 75°.

It is understood that the features shown in FIG. 8 is applicable to all embodiments described herein.

Supplying the fluid for creating a clean zone around the at least one working station 140*a*, 140*b* 140*c* at a distribution angle of 90° or more from the axis A is not desirable since it will not provide an even an uniform flow of fluid for creating a clean zone from the fluid inlet 120 towards the floor 113.

It is appreciated that certain features of the invention, which, for clarity, have been described above in the context of separate configurations, may also be provided in combination in a single configuration. Conversely, various features of the invention, which, for brevity, have been described in the context of a single configuration, may also be provided separately or in any suitable sub-combination.

LIST OF REFERENCES

| | |
|---|---|
| 100 | Filling machine |
| 110 | Working chamber |
| 111 | Side walls |
| 112 | Ceiling |
| 113 | Floor |
| 114a | Inlet side |
| 114b | Outlet side |
| 115 | Conveyor |
| 117 | Filling region |
| 118 | Closing region |
| 119 | Wall |
| 120 | Fluid inlet |
| 121 | Fluid inlet surface |
| 121' | First surface area |
| 121" | Second surface area |
| 122 | Through openings |
| 123a | Supply conduit cleaning nozzle |
| 123b | Working chamber cleaning nozzle |
| 124 | Pipe |
| 125 | Supply conduit |
| 130 | Container |
| 131 | Container top end |
| 132 | Container bottom end |
| 140a | Filling station |
| 140b | Heating station |
| 140c | Sealing station |
| 150 | Decontamination tunnel |

The invention claimed is:

1. A filling machine comprising;

a working chamber comprising side walls, a ceiling and a floor, wherein containers are conveyed through the working chamber by a conveyer, from an inlet side to an outlet side, wherein the working chamber comprises at least one station within the working chamber configured to execute a working step on the containers, wherein the filling machine comprises a plurality of fluid inlets, wherein each fluid inlet comprises a convex fluid inlet surface facing the working chamber and displaying a plurality of through openings configured to supply the working chamber with a fluid for creating a clean zone around the at least one station, and wherein each fluid inlet is fluidly connected to a supply conduit for supplying the fluid to the working chamber, and wherein the fluid inlet surface has the shape of a spherical or an ellipsoidal cap.

2. The filling machine according to claim 1, wherein the cross section of the supply conduit increases towards the end proximal to the fluid inlet.

3. The filling machine according to claim 1, wherein the supply conduit comprises a cleaning nozzle disposed within the supply conduit or spraying a cleaning medium onto the inner surface of the supply conduit and the fluid inlet.

4. The filling machine according to claim 1, wherein the supply conduit has a circular cross section.

5. The filling machine according to claim 1, wherein each fluid inlet is fluidly connected to a respective supply conduit.

6. The filling machine according to claim 1, wherein the working chamber is divided into a filling region and a closing region by a wall extending transversely within the working chamber, wherein the filling region is proximal to the inlet side and the closing region is proximal to the outlet side.

7. The filling machine according to claim 6, wherein the filling region comprises at least one of said plurality of fluid inlets, and wherein the closing region comprises at least one of said plurality of fluid inlets.

8. The filling machine according to claim 7, wherein the filling region comprises at least two of said plurality of fluid inlets, and wherein the closing region comprises at least two of said plurality of fluid inlets.

9. The filling machine according to claim 6, wherein the filling region comprises a filling station for filling containers, and wherein the closing region comprises a heating station for heating the containers and a sealing station for sealing the containers.

10. The filling machine according to claim 1, wherein the supply conduit and the fluid inlet surface comprises a longitudinal axis, wherein the fluid inlet surface comprises a first surface area with a surface curvature having a first radius r1 and a second surface area with a surface curvature having a second radius r2, wherein the first radius r1 is greater than the second radius r2, and wherein the through openings comprised in the first surface area with a surface curvature having a first radius r1 is configured to distribute the fluid for creating a clean zone around the at least one station at a distribution angle of max Y° from the axis, covering a larger area distal from the fluid inlet surface than proximal to the fluid inlet surface, wherein Y° is between 10°-40°, and/or wherein the through openings comprised in the second surface area with a surface curvature having a second radius r2 is configured to distribute the fluid for creating a clean zone around the at least one station at a distribution angle of max X° from the axis A, covering a larger area distal from the fluid inlet surface than proximal to the fluid inlet surface, wherein X° is between 40°-89°.

11. The filling machine according to claim 1, wherein the fluid inlet surface comprises a first surface area with a surface curvature having a first radius r1 and a second surface area with a surface curvature having a second radius r2, wherein the first radius r1 is greater than the second radius r2, wherein the fluid inlet surface is configured to supply the working chamber with the fluid for creating a clean zone around the at least one station at a ratio for providing a larger portion of the fluid for creating a clean zone around the at least one station through the through openings displayed in the first surface area with a surface curvature having a first radius r1 than through the second surface area with a surface curvature having a second radius r2, said ratio of fluid for creating a clean zone around the at least one station between the supply from the first surface area with a surface curvature having a first radius r1 and second surface area with a surface curvature having a second radius r2 is between 10:9-10:1.

* * * * *